United States Patent [19]

Akatsu et al.

[11] Patent Number: 5,052,811

[45] Date of Patent: Oct. 1, 1991

[54] APPARATUS FOR BLENDING FRICTION MATERIAL

[75] Inventors: Yozo Akatsu; Toshiyasu Ichimura, both of Saitama, Japan

[73] Assignee: Akebono Brake Industry Co., Ltd., Tokyo, Japan

[21] Appl. No.: 510,263

[22] Filed: Apr. 19, 1990

[30] Foreign Application Priority Data

Apr. 28, 1989 [JP] Japan ..... 1-107165

[51] Int. Cl.[5] ..... B01F 15/04

[52] U.S. Cl. ..... 366/141; 366/156

[58] Field of Search ..... 366/18, 16, 19, 20, 366/21, 152, 155, 156, 158, 157, 162, 141

[56] References Cited

U.S. PATENT DOCUMENTS

| | | | |
|---|---|---|---|
| 2,568,821 | 9/1951 | Perrot | 366/18 |
| 4,402,349 | 9/1983 | Engert | 366/18 |
| 4,525,071 | 6/1985 | Horowitz | 366/152 |

*Primary Examiner*—Robert W. Jenkins

*Attorney, Agent, or Firm*—Finnegan, Henderson, Farabow, Garrett and Dunner

[57] ABSTRACT

Apparatus for blending a friction material includes a number of hoppers for holding components of the friction material, respectively, each of the hoppers having a discharge port for discharging the component. Screw feeders are connected respectively to the hoppers so as to transfer the components discharged from the discharge ports. Vibration feeders transfer the components, fed from the screw feeders, respectively. A plurality of weighing devices receive the components, fed from the vibration feeders, respectively, and weigh the components. The weighing devices have different weighing capacities. An agitator receives all the components from the weighing devices, and agitates the components. Each of the weighing devices is movable between each of the vibration feeders and the agitator.

4 Claims, 3 Drawing Sheets

APPARATUS FOR BLENDING FRICTION MATERIAL

BACKGROUND OF THE INVENTION

1. Field of the Invention

The present invention relates to an apparatus for blending a friction material for use in a brake or other devices.

2. Related Art

The blending of a friction material of the type described has conventionally been effected mainly manually. More specifically, various components of the friction material, such as a reinforcing material, friction modifiers and a binder, are taken out of respective raw material cans, and are manually metered or weighed, and appropriate amounts of these components are manually charged into an agitator.

In the conventional blending of the friction material, the operator must directly touch fibrous or powdery raw materials. Thus, the environment in which the operator works is bad. Particularly, since the operator touches the harmful raw material such as asbestos during the blending operation, it is of urgent necessity to improve the working environment. In addition, since the conventional blending of the friction material mainly depends on a manual operation, the efficiency of the operation is low, and other problems, such as a weighing error due to the manual weighing and an error in selection of the raw materials, have been encountered.

SUMMARY OF THE INVENTION

It is therefore an object of this invention to overcome the above deficiencies of the conventional apparatus for blending a friction material. That is, an object of the invention is to provide an apparatus for blending a friction material with which the environment for the operator works is improved.

It is another object of the invention to provide an apparatus for blending a friction material having a high weighing accuracy.

It is still another object of the invention to provide an apparatus for blending a friction material by which the efficiency of the operation is high.

The above and other objects can be achieved by a provision of an apparatus for blending a friction material which, according to the present invention, is provided with a number of hoppers for holding components (reinforcing material, friction modifiers, a binder and etc.) of the friction material, respectively, each of the hoppers having a discharge port for discharging the component, screw feeders connected respectively to the hoppers so as to transfer the components discharged from the discharge ports, vibration feeders for transferring the components, fed from the screw feeders, respectively, a plurality of weighing devices for receiving the components, fed from the vibration feeders, respectively, and for weighing the components, the weighing devices having different weighing capacities, and an agitator for receiving all the components from the weighing devices and for agitating the components, each of the weighing devices being movable between each of the vibration feeders and the agitator.

Each of the vibration feeders can comprise a trough having a pair of inclined surfaces defining a V-shape, and a plurality of baffle plates mounted on the pair of inclined surfaces, the position of mounting of the baffle plates in a direction of inclination thereof as well as the angle of mounting thereof being adjustable.

The apparatus can further comprise a can for receiving all the components from the weighing devices, and transfer means for transferring the can to the agitator.

Appropriate amounts of the components of the friction material, which are different in blending ratio in accordance with the kind and application of the friction material, are sequentially fed respectively from the discharge ports of the hoppers to the vibration feeder 4 by the screw feeders. At the same time, the vibration feeders are driven to further transfer the components. At this time, one of the weighing devices having the weighing capacity suited for the component has been moved to a position beneath the forward end of the vibration feed. Therefore, the component discharged from the hopper is fed to one of the weighing devices via the vibration feeder. When the amount of this feed reaches a predetermined value, the driving of the screw feeders as well as the driving of the vibration feeders are stopped.

Thus, by suitably using the plurality of weighing devices, the appropriate amounts of the components, different in blending ratio in accordance with the kind, etc. of the friction material, are supplied to the selected one of the weighing devices. Then, all the components are charged into the agitator. All the components charged into the agitator are agitated for a predetermined time period, and uniformly mixed together. The vibration feeder has the V-shaped trough defined by the pair of inclined surfaces, and the baffle plates are mounted on the trough in such a manner that the position of mounting of the baffle plates in the direction of inclination thereof as well as the angle of mounting thereof can be adjusted. Therefore, in accordance with the kind, amount and nature (i.e., fibrous or powdery) of each component of the friction material fed from the hopper via the screw feeder, the position of mounting of each baffle plate in the direction of inclination thereof as well as its mounting angle can be adjusted. By doing so, the amount of transfer or feed of the component to the weighing device per unit time is made uniform. More specifically, the vibration source for the vibration feeder is vibrated at a frequency suited for each component of the friction material, and the component is fed by the trough. At this time, the component is discharged from the screw feeder to the trough in a slightly irregular manner, so that the component is heaped-up on the trough. The component can ride over the baffle plates at a certain high vibration frequency, but can not ride over the baffle plates at a certain low vibration frequency. Therefore, the amount of transfer of the component on the trough is varied, that is, increased and decreased, and as the component passes over the baffle plates, the feed amount is gradually averaged, and is generally uniformly supplied to the weighing device. As a result, a weight error is kept to a very low level, thus achieving an accurate weighing.

The can can be provided below the weighing device, and all the components in each weighing device are transferred to the can, and then the can can be transferred to the agitator by the transfer means, so that the components can be charged into the agitator.

DESCRIPTION OF THE PREFERRED EMBODIMENT

The present invention embodied in an apparatus for blending a friction material of a friction pad (hereinafter referred to as "disc pad") for a disc brake will now be described with reference to the drawings.

FIGS. 1 to 5 show a preferred embodiment of the invention. A number of hoppers 1 hold various components (raw materials) of the disc pad friction material, respectively. The components of the friction material, such as a reinforcing material, friction modifiers, a binder and so on, are held in the hoppers 1, respectively. Examples of the reinforcing material include asbestos, steel fibers, copper particles and iron particles. Examples of the friction modifiers include an organic material such as rubber particles, cashew dust and polymer particles, an inorganic material such as barium sulphate, calcium carbonate, graphite and molybdenum disulphate, powder of metal such as copper, brass, aluminum and zinc, and an oxide such as alumina and silica. Examples of the binder include a thermosetting resin such as a degenerated phenol resin. The hoppers 1 are arranged on a slab 10 in opposed two rows, and the total of the hoppers 1 is about 50.

Figure 3:
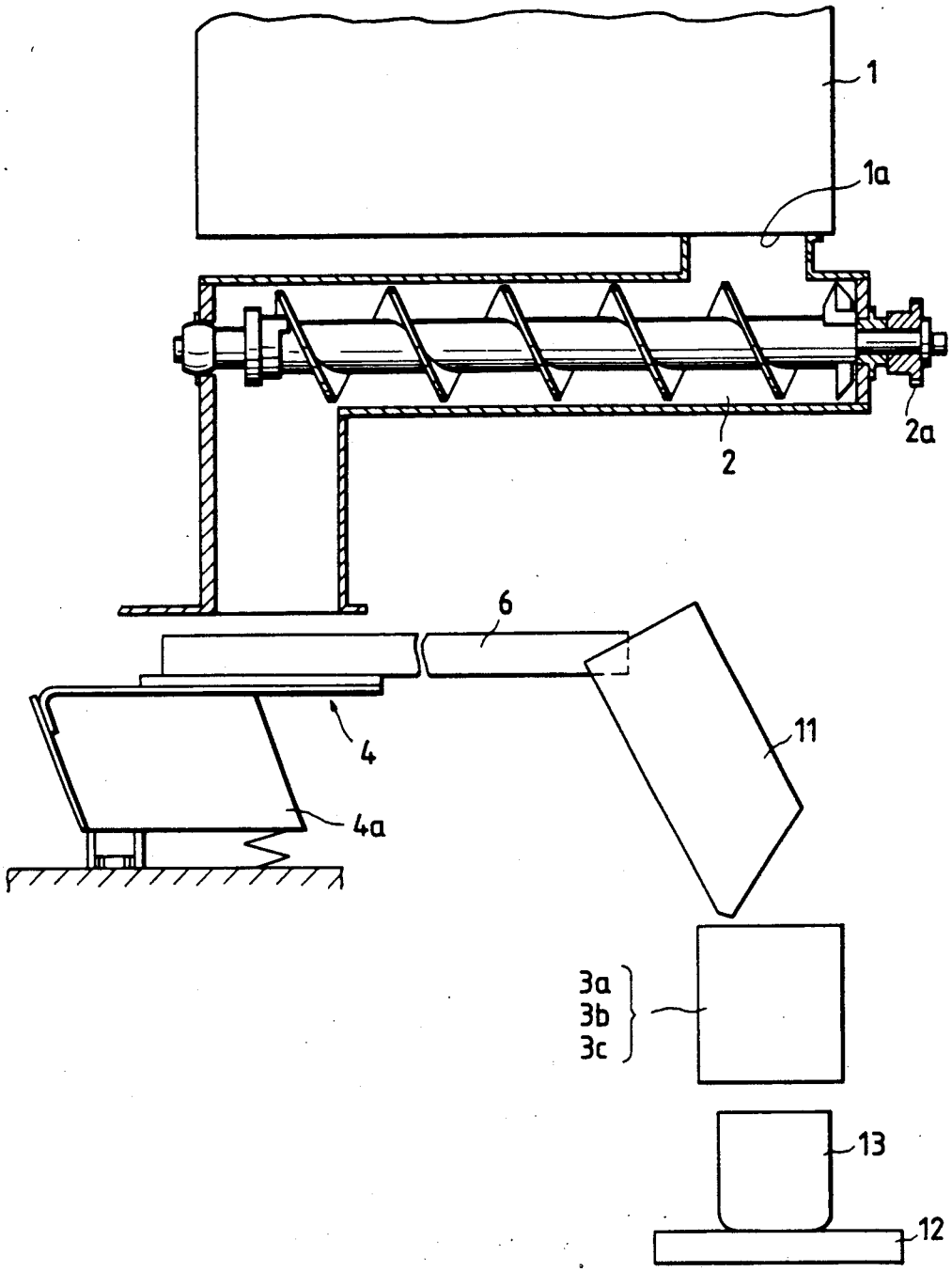
FIG. 3 is a partly-broken, side-elevational view of an important portion of the apparatus.

As clearly shown in FIG. 3, a screw feeder 2 is associated with a discharge port 1*a* of each of the hoppers 1, the discharge port 1*a* being provided at the bottom of each hopper 1. Each screw feeder 2 serves to feed a respective one of the components of the disc pad friction material discharged from the corresponding hopper 1. A vibration feeder 4 is provided for receiving the component of the disc pad friction material fed by the screw feeder 2 rotated by a sprocket 2*a*, for changing the direction of feed of the component, and for further feeding the component. Each vibration feeder 4 includes a trough 6 vibrated by a vibration source 4*a* whose vibration frequency is variable.

Figure 1:
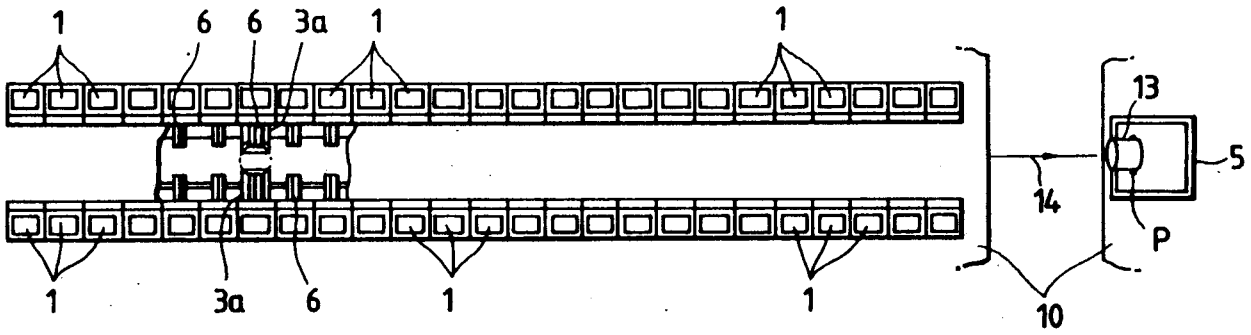
FIG. 1 is a partly-broken, plan view of a disc pad friction material blending apparatus provided in accordance with the present invention.
Figure 2:
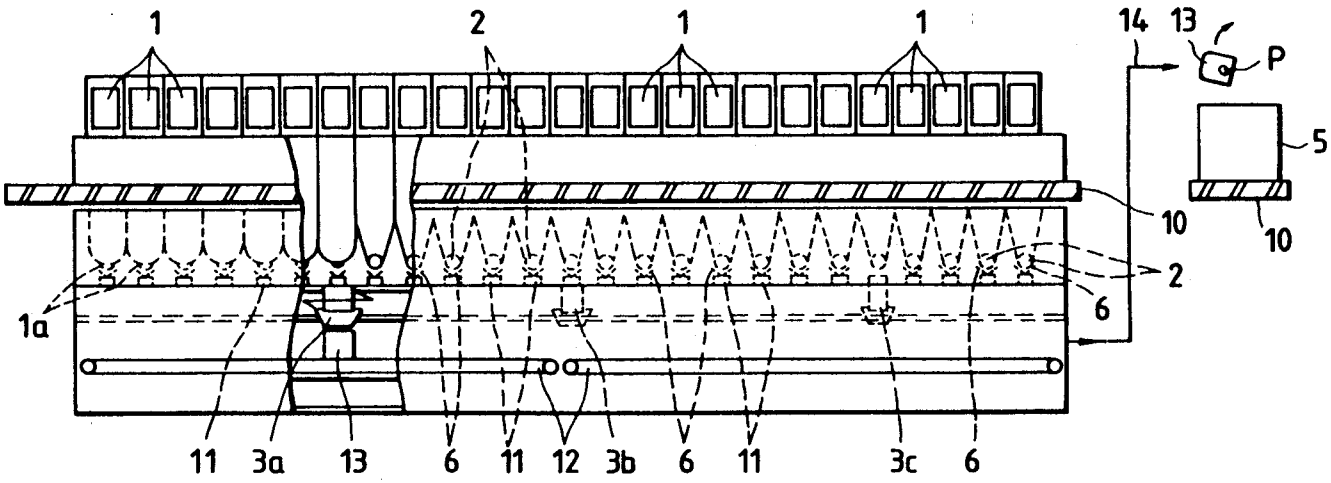
FIG. 2 is a partly-broken, front-elevational view of the apparatus.

A chute 11 of a channel-shaped cross-section is provided at the forward end of the trough 6, and is slanted downwardly. The component of the disc pad friction material discharged from the trough 6 is guided by the chute 11 and is fed to one of a plurality of (three in this embodiment) weighing devices 3*a*, 3*b* and 3*c*. The plurality of weighing devices 3*a*, 3*b* and 3*c* have different weighing capacities (maximum weighing capacities) so that they can accurately weigh the components (i.e., the reinforcing material, the friction modifiers, the binder and etc.) of the disc pad friction material which are greatly different in their contents of the blend. The weighing devices 3*a*, 3*b* and 3*c* are movable along a common travel path extending along each row of the hoppers 1. Each of the weighing devices 3*a*, 3*b* and 3*c* is moved in right and left directions (FIG. 1), and receives the component of the disc pad friction material discharged from the chute 11 connected to the hopper 1. A can 13 is placed on a belt conveyer 12 arranged below the weighing devices 3*a*, 3*b* and 3*c*. The belt conveyer 12 is moved in right and left directions (FIG. 1). An elevator mechanism 14 is provided adjacent to one end of the belt conveyer 12, and upwardly moves the can 13 transferred to the one end of the belt conveyer 12. The belt conveyer 12 and the elevator mechanism 14 jointly constitute a transfer means for transferring the can 13 to an agitator 5. In the agitator 5, the can 13 moved upward by the elevator mechanism 14 is turned over by a turn device (not shown) about an axis P, so that all the components of the disc pad friction material are charged into the agitator 5.

Figure 4:
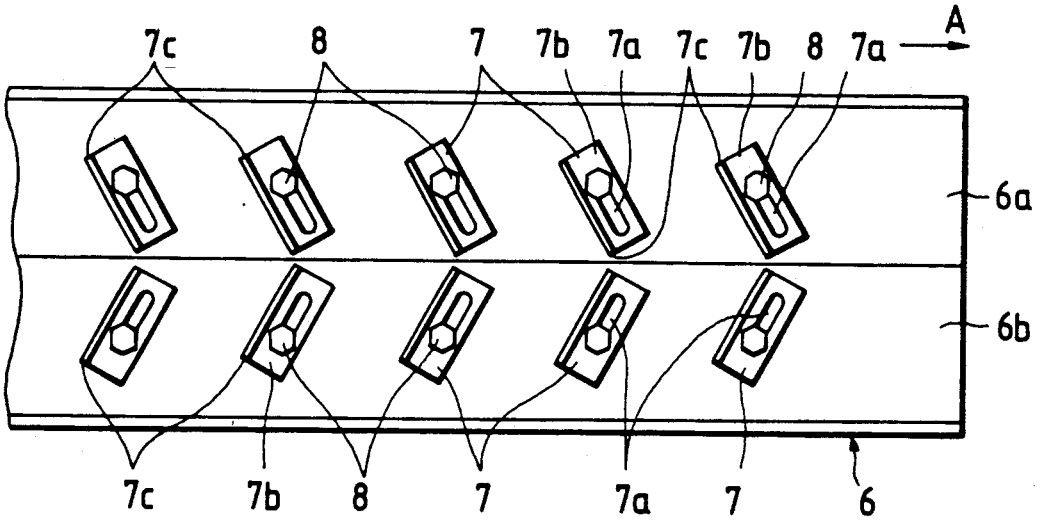
FIG. 4 is a plan view of a trough of a vibration feeder of the apparatus.
Figure 5:
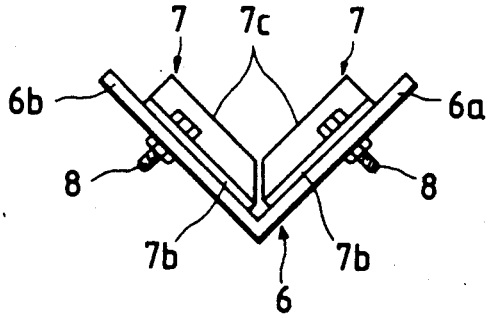
FIG. 5 is a side-elevational view of the trough.

As clearly shown in FIGS. 4 and 5, the trough 6 of each vibration feeder 4 has a V-shaped cross-section defined by a pair of inclined surfaces 6*a* and 6*b*. A plurality of baffle plates 7 are mounted on each of the inclined surfaces 6*a* and 6*b* by fastening means 8 such as a bolt and a nut in such a manner that the position of each baffle plate 7 is adjustable. More specifically, each baffle plate 7 has an L-shaped cross-section defined by two legs 7*b* and 7*c*. The baffle plate 7 is fixedly connected to the trough 6 by the fastening means passing through a slot 7*a* formed through and extending along the leg 7*b*. The other legs 7*c* extend upwardly from the inclined surfaces 6*a* and 6*b*, and apply a suitable degree of resistance to each component of the disc pad friction material flowing in a direction of arrow A (FIG. 4). Each pair of opposed baffle plates on the inclined surfaces 6*a* and 6*b* are inclined and converge toward the bottom of the trough 6. With this arrangement, by loosening the fastening means 8 and sliding each baffle plate 7 in its longitudinal direction, the position of the baffle plate 7 in the direction of inclination thereof can be adjusted. Also, by loosening the fastening means 8 and angularly moving the baffle plate 7, the angle of mounting of the baffle plate 7 can be adjusted.

The operation will now be described.

In accordance with the kind and application of the disc pad, that is, the blending ratio of the reinforcing material of the organic type, the semi-metallic type or the inorganic type, the friction modifiers, the binder and etc., appropriate amounts of the required components of the disc pad friction material are sequentially fed respectively from the discharge ports 1*a* of the hoppers 1 to the troughs 6 of the vibration feeders 4 by the screw feeders 2. At the same time, the vibration sources 4*a* for the vibration feeders 4 are driven to cause the troughs 6 to transfer the components of the disc pad friction material. At this time, one of the weighing devices 3*a*, 3*b* and 3*c* having the weighing capacity suited for the component has been moved to a position beneath the forward end of the trough 6. Therefore, the component of the disc pad friction material discharged from the hopper 1 is fed to one of the weighing devices 3*a*, 3*b* and 3*c* via the vibration feeder 4. When the amount of this feed reaches a predetermined value, the driving of the screw feeders 2 as well as the driving of the vibration sources 4*a* for the vibration feeders 4 are stopped.

Thus, by suitably using the plurality of weighing devices 3*a*, 3*b* and 3*c*, the appropriate amount of each component of the disc pad friction material in the predetermined blending ratio is supplied to the selected one of the weighing devices 3*a*, 3*b* and 3*c*. Then, the belt conveyer 12 is driven, and all the components in one of the weighing devices 3*a*, 3*b* and 3*c* are transferred to the can 13 disposed below that weighing device.

Then, the belt conveyer 12 is driven to transfer or move the can 13 to the one end of the belt conveyer 12, and the can 13 is moved upward by the elevator mechanism 14. Then, the can is turned over by the turn device so as to charge all the components of the disc pad friction material into the agitator 5. All the components of the disc pad friction material in the agitator 5 are agitated for a predetermined time period (about 3 to about 5 minutes), and uniformly mixed together. In the illustrated embodiment, although the three weighing devices 3*a*, 3*b* and 3*c* are provided at each row of the hoppers, they may be commonly provided between the two rows. Further, the component of the disc pad friction material discharged from each hopper 1 may be transferred to the can 13 each time the weighing of this component is carried out. Also, to reduce the weighing time, each component in an amount used for several disc pads may be fed to the weighing device 3*a*, 3*b* or 3*c*, considering the weighing capacity thereof, in which case such increased amount of the component is transferred from the weighing device to the can 13.

As described above, the vibration feeder 4 has the trough 6 as shown in FIG. 4. Therefore, in accordance with the kind, amount and nature (i.e., fibrous or powdery) of each component of the disc pad friction material fed from the hopper 1 via the screw feeder, the position of mounting of each baffle plate 7 in the direction of inclination thereof as well as its mounting angle can be adjusted. By doing so, the amount of transfer or feed of the component to the weighing device 3*a*, 3*b* or 3*c* per unit time is made uniform. More specifically, the vibration source 4*a* for the vibration feeder 4 is vibrated at a frequency suited for each component of the disc pad friction material, and the component is fed by the trough 6. At this time, the component is discharged from the screw feeder 2 to the trough 6 in a slightly irregular manner, so that the component is heaped-up on the trough 6. The component can ride over the baffle plates 7 at a certain high vibration frequency, but can not ride over the baffle plates 7 at a certain low vibration frequency. Therefore, the amount of transfer of the component on the trough 6 is varied, that is, increased and decreased, and as the component passes over the baffle plates 7, the feed amount is gradually averaged, and is generally uniformly supplied to the weighing device 3*a*, 3*b* or 3*c*. As a result, a weight error is kept to a very low level, thus achieving an accurate weighing.

The disc pad friction material agitated by the agitator 5 is fed to the next stage, that is, to a dryer where the friction material is dried to a predetermined level.

As will be appreciated from the foregoing, the present invention provides the following advantages:

(1) The components of the friction material are fed from the respective hoppers via the respective screw feeders and vibration feeders to any one of the weighing devices. After the components are weighed by the weighing devices, the components are charged into the agitator for agitation purposes. Thus, the blending of the components of the friction material is carried out automatically and hence is not effected manually. Therefore, the blending operation can be carried out efficiently, and besides an error in selection of the material is prevented. Further, since the operator does not directly touch harmful substances such as asbestos, an operator safety is achieved.

(2) There are provided the plurality of weighing devices having different weighing capacities, and the weighing device suited for weighing each component can be selected. Therefore, a high weighing accuracy can be achieved. As a result, the loss of each components of the friction material is reduced, thus improving the yield.

(3) Since each of the weighing devices is designed to be moved, it is only necessary to provide the weighing device between the vibration feeder and the agitator. This enables the construction of the friction material blending apparatus to be simplified.

(4) The baffle plates are mounted on the pair of inclined surfaces assuming a V-shape in such a manner that the position of mounting of the baffle plates in the direction of inclination thereof as well as their mounting angle can be varied. Therefore, in accordance with the kind, amount and nature of each of the components of the friction material, the position of mounting of the baffle plates in the direction of inclination thereof as well as their mounting angle can be determined or set, and in combination with the variation of the vibration frequency, each component of the friction material can be uniformly fed to the weighing device. As a result, there can be provided the friction material blending apparatus which has a high weighing accuracy.

What is claimed is:

1. An apparatus for blending components of a friction material, comprising:

a plurality of hoppers for holding the components of the friction material, each of said hoppers having a discharge port for discharging the components;

a plurality of screw feeders connected to respective ones of said hoppers for transferring the components discharged from said discharge ports;

a plurality of vibration feeders for further transferring the components transferred by respective ones of said screw feeders;

a plurality of weighing devices for receiving the components transferred by respective ones of said vibration feeders and for weighing the components, each of said weighing devices having a different weighing capacity; and an agitator for receiving the components from each of said weighing devices and for agitating the components, each of said weighing devices being movable between each of said vibration feeders and said agitator.

2. The apparatus according to claim 1, wherein each of said vibration feeders comprises a trough having a pair of inclined surfaces defining a V-shape, and a plurality of baffle plates mounted on said pair of inclined surfaces, a position of mounting of said baffle plates in a direction of inclination thereof being adjustable.

3. The apparatus according to claim 2, wherein an angle of mounting of said baffle plates is adjustable.

4. The apparatus according to claim 1, further comprising a can for receiving the components from each of said weighing devices, and transfer means for transferring said can to said agitator.

* * * * *